United States Patent [19]

Sears

[11] 4,008,856

[45] Feb. 22, 1977

[54] RECLAIMING SYSTEM FOR FOUNDRY SAND

[76] Inventor: Edward A. Sears, W. 708 Cliff Drive, Spokane, Wash. 99204

[22] Filed: Sept. 17, 1975

[21] Appl. No.: 614,323

[52] U.S. Cl. ..... 241/46 R; 241/79.1; 241/DIG. 10

[51] Int. Cl.[2] ..... B02C 23/36

[58] Field of Search ..... 241/14, 20, 23, 24, 241/79.1, 184, DIG. 10, 46 R, 46.02

[56] References Cited

UNITED STATES PATENTS

| | | | |
|---|---|---|---|
| 2,331,102 | 10/1943 | Bird | 241/DIG. 10 |
| 2,383,045 | 8/1945 | Den Breejen et al. | 241/DIG. 10 |
| 2,477,948 | 8/1949 | Allen | 241/DIG. 10 |
| 3,028,104 | 4/1962 | Hall | 241/184 |
| 3,549,092 | 12/1970 | Baxter, Jr. | 241/79.1 |

*Primary Examiner*—Granville Y. Custer, Jr.
*Attorney, Agent, or Firm*—Wells, St. John & Roberts

[57] ABSTRACT

A reclaiming system for used foundry sand containing a sodium silicate (water glass) binder. The resulting chunks of sand and binder are disintegrated by mechanical crushing in a water wash. A primary slurry containing discrete particles of sand and both dissolved and suspended binder is conveyed to a settling tank where the sand settles from the slurry. The heavier particles of sand are removed by a ladder conveyer, which allows liquid to drain from the sand as it is being elevated. The sand is dried in rotary drum dryers, being subjected to a constant flow of heated air. The remaining secondary fluid, containing particles of binder, is directed to a centrifugal separator, where the suspended materials such as binder particles are removed from the liquid. The liquid is then recirculated in the system, eliminating discharge of liquid or the need for substantial replenishing of liquid during the process.

3 Claims, 7 Drawing Figures

RECLAIMING SYSTEM FOR FOUNDRY SAND

BACKGROUND OF THE INVENTION

This invention relates generally to a system for reclaiming foundry sand. It is directed specifically to the reclaiming of sand used in a foundry in combination with sodium silicate binders.

Binders, such as sodium silicate (water glass), are used in foundry molds and cores to impart desirable strength and surface characteristics in sand casting processes. Use of sodium silicate binders allows a foundry to obtain closer tolerances in sand castings. The relatively high strength of the molds allows them to be used without back-up aids, such as jackets, flasks, and bottoms. Sodium silicate-sand mixtures strengthened by carbon dioxide are used widely for cores, because the cores can be quickly made and are ready to use without baking. Expendable cores used in permanent mold casting are commonly made by the sodium silicate-carbon dioxide process because of the dimensional accuracy obtainable. The process is suitable for all common castings alloys, including aluminum and magnesium. It is most widely used, however, for casting of steel, cast iron and copper alloys.

After use, the chunks of sand and sodium silicate binder are often discarded. Conventional wet sand-reclamation systems are expensive and somewhat inefficient. They often are not economically practical except in areas where the freight cost of new sand overshadows the cost of reclaiming used sand. Only relatively small percentages of reclaimed sand can be used, requiring substantial addition of new sand for reuse.

The purpose of this disclosure is to introduce a system for reclaiming used foundry sand containing sodium silicate binders in a continuous economical process which makes possible wide-scale usage of sodium silicate binders for general foundry use. Such usage will permit a foundry to capitalize on the dimensional stability of the sand-binder mixture now felt justifiable only for more precise casting requirements and for cores.

The system comprises a new process for handling the used sand during reclamation and new equipment used in that process.

For a general discussion of present foundry practice relating to sand molding, see *Metals Handbook*, 8th edition (1970) Volume 5 (Forging and Casting), published by the American Society for Metals, Metals Park, Ohio, pages 155–180. A discussion of the use of the sodium silicate binders in specific molding processes can be found in this publication at pages 203–208. Production of sand cores is described in the publication at pages 209–221. These portions of the publication are considered to constitute an examplary discussion of the state-of-the-art relating to utilization and reclamation of foundry sand including sodium silicate binders, and are hereby incorporated by reference in this specification.

SUMMARY OF THE INVENTION

This invention comprises a novel system for reclaiming used foundry sand. It basically assures proper disintegration of used sand lumps containing a binder, washing of the sand during tumbling, to produce a suspended slurry and subsequent settling and separation of the sand for reuse. Water used in the system is continuously recycled through a unique centrifugal separator.

A first object is to produce a practical system for reclaiming used foundry sand, wherein the recycled sand is capable for reuse without the addition of new sand.

Another object is to provide a system which is economical to operate and physically compact. The system does not pose any significant environmental problems in a foundry installation.

Other objects will be apparent from the following description.

DESCRIPTION OF THE PREFERRED EMBODIMENT

Figure 1:
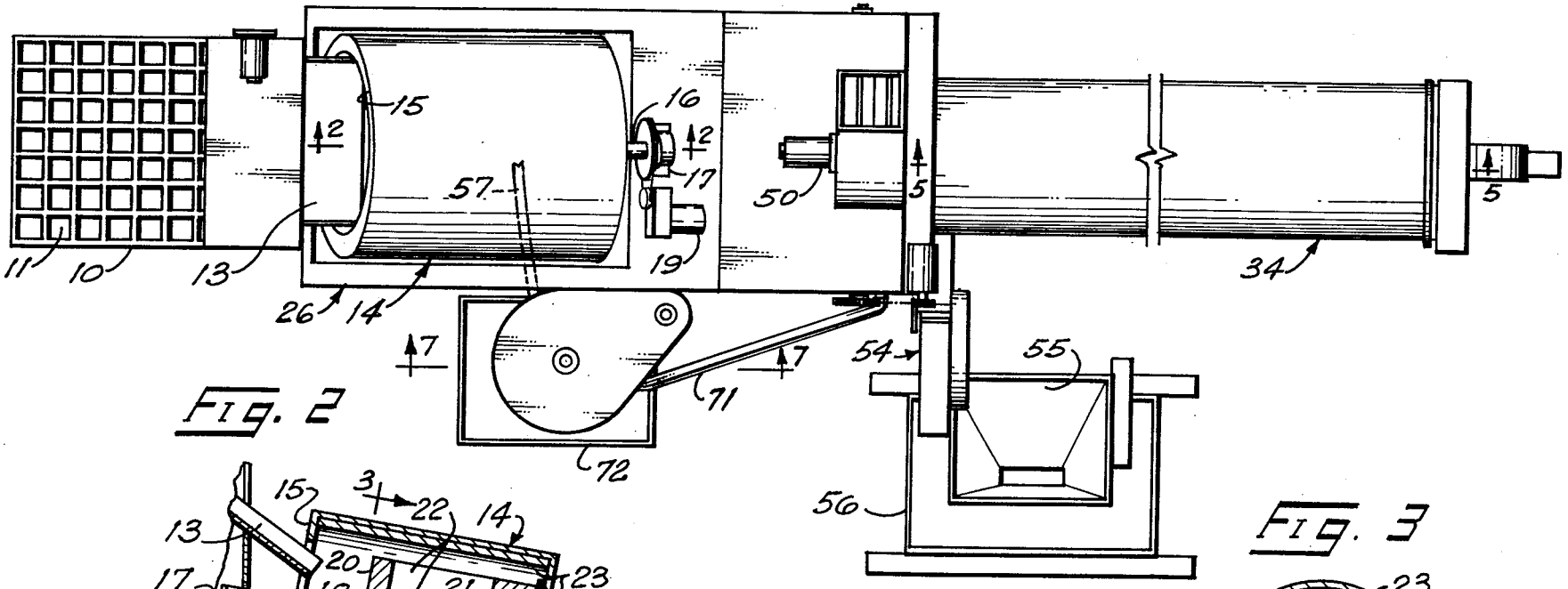
FIG. 1 is a plan view of an apparatus for the system.
Figure 3:
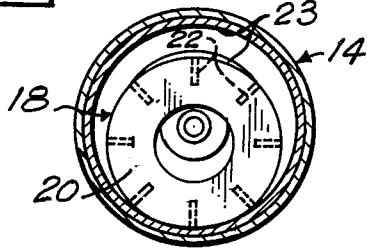
FIG. 3 is a sectional view taken along line 3—3 in FIG. 2.

This disclosure relates to the reclaiming of used foundry sand. It is directed specifically to the reclaiming of sand after use in mold or core forming processes with a binder of sodium silicate. Several conventional foundry processes utilize sodium silicate binders, and the nature of these processes is well-recognized in the foundry industry. However, the utilization of these processes has been not economically feasible except where the job requirements justify single use of the sand involved. Available reclamation methods and systems do not permit complete recycling or reuse of sand after use with sodium silicate binders. Methods used to date permit only limited reuse of reclaimed sand and involve substantial capital investments in equipment for scrubbing the sand. These methods have not removed a sufficient amount of the silica ions, with the result that the reclaimed sand must be mixed with substantial amounts of new sand if it is to be reused at all. The system described below has been successfully used to reclaim such used sand and has permitted recycling of sand without addition of any new sand. The system does effectively remove the silica ions to permit reuse. It has been found that repeated recycling of the sand in foundry use stabilizes the quantity of silica ions at a level acceptable for reuse in mold or core forming procedures. Sand processed according to this disclosure has been successfully used numerous times without any replenishing of sand. The recycled sand appears to be reusable so long as the granular nature of the sand meets the quality standards required by the processes involved.

Basically, such a system requires careful disintegration of the lumps of sand and sodium siicate to separate the two materials without damaging the particles of sand. After such disintegration, it is necessary to effectively separate the sand, which then can be reused. This must be accomplished in such a fashion as to leave a very low residual amount of silica ions in the sand, which would otherwise be detrimental to effective binding of the sand during subsequent usage. Finally, it is essential to effectively remove the sodium silicate and other additives and unwanted materials from the liquid wash, this being done in such a fashion as to eliminate the usual need for large quantities of liquid, settling ponds, and other environmentally disadvantageous procedures. It also is important that the system not produce any dust or noxious gases for release to the atmosphere.

The present process accomplishes these ends. The first step is to disintegrate the solid lumps of sand and sodium silicate binder, freeing the discrete solid particles of sand and binder for separation purposes. The used sand is dumped upon a grate 10 having openings of a size equal to the maximum size of the lumps which can be effectively handled by the system. The bulk of the used sand and binder will fall freely through grate 10. The larger lumps resting on grate 10 must be broken manually or otherwise treated by machinery outside the scope of this disclosure.

Figure 2:
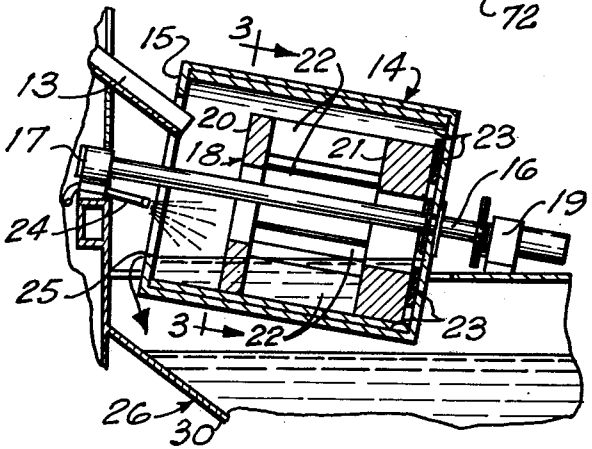
FIG. 2 is a fragmentary sectional view through the crushing drum assembly as seen along line 2—2 in FIG. 1.
Figure 4:
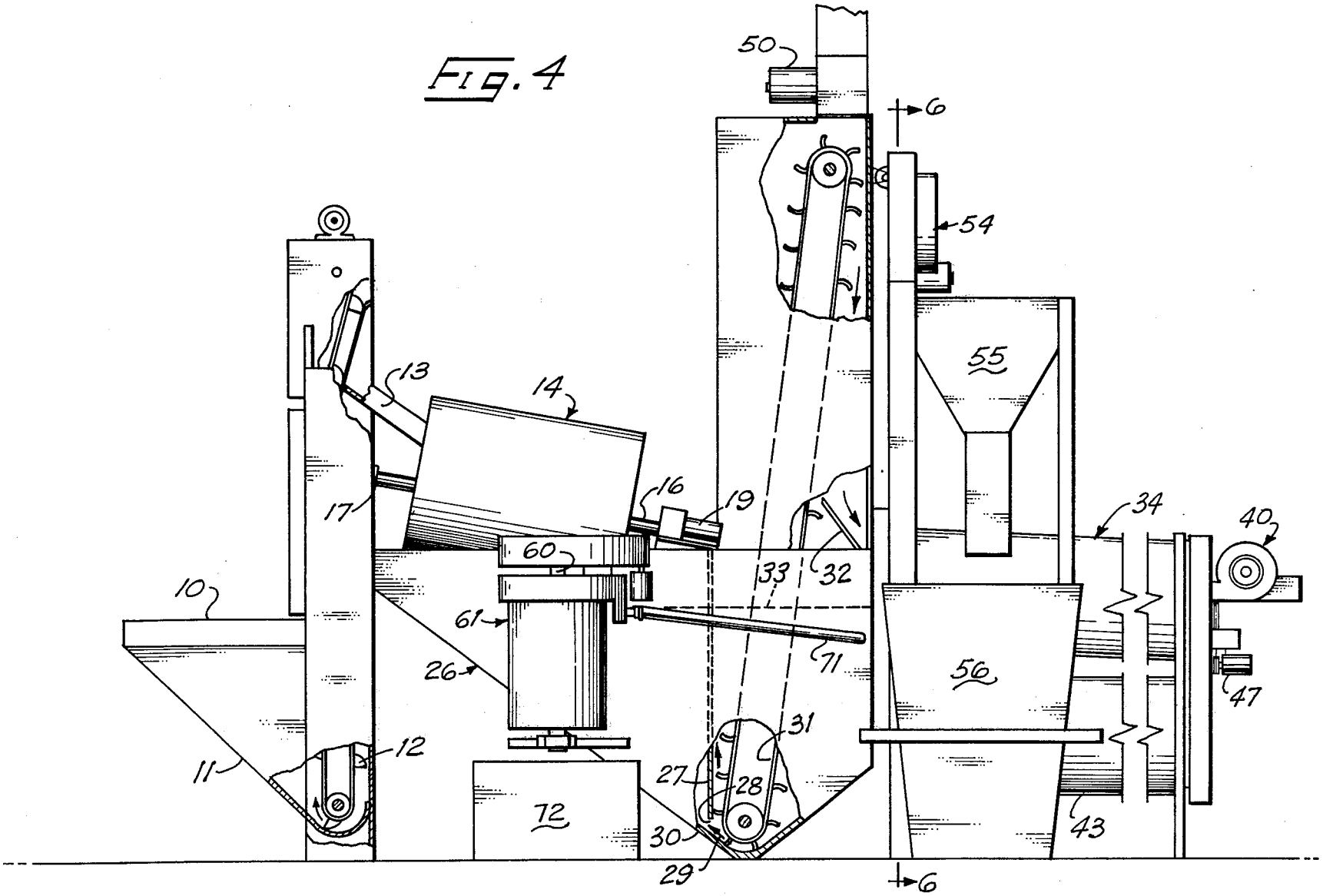
FIG. 4 is an elevation view of the apparatus as seen from the bottom of FIG. 1.

The used sand falls upon an inclined floor 11 beneath grate 10 and is directed onto an elevating bucket conveyor shown generally at 12. The conveyer 12 lifts the sand and lumps of material from the lower end of floor 11 and deposits it onto a chute 13 (FIGS. 1, 2 and 4).

Chute 13 directs the material into a drum 14 for disintegration of lumps of sand and binder. Drum 14 is axially open at one end, the interior contents being confined by an annular lip 15. The sides and lower end of drum 14 are liquid-impervious. The lower end of drum 14 is supported on a shaft 16 that extends through the drum coaxially with respect to the drum sides. Shaft 16 is rotatably carried by bearings 17 on the supporting framework for the machinery and is powered by a motor and drive assembly 19, including a driven sprocket on shaft 16.

The interior of drum 14 loosely carries a vaned tumbler 18 including an upper annular member 20, a lower annular member 21, and a plurality of radial vanes 22. Vanes 22 are rigidly fixed between the members 20 and 21. The outer diameters of members 20, 21 and vanes 22 are identical to one another, giving the tumbler 18 a generally cylindrical shape, open in the radial spaces bounded by these elements. The diameter of drum 18 is less than the inside diameter of drum 14. Furthermore, the inner diameter of members 20, 21 is such as to provide clearance between the drum 18 and shaft 16 (see FIG. 2). Thus, as the drum 14 is rotated about the axis of shaft 16, tumbler 18 is free to roll within the interior of drum 14. The lower end of tumbler 18 rests against the interior of drum 14. It is frictionally supported by wear plates 23, on the lower end of drum 14 and along the interior side surfaces, which can be constructed of suitable resin hardened metal or other material capable of withstanding frictional rubbing engagement between tumbler 18 and drum 14 with a mininum of wear.

Water is supplied to the interior of drum 14 by a supply pipe shown at 24. The supply of water is continuous at all times during operation of the machine. The level of liquid within drum 14 is governed by the elevation of the lower portion of lip 15 and is indicated in FIG. 2 by the reference numeral 25.

In use, the lumps of sand and binder, as well as loose sand and other particles, are agitated by the rolling action of tumbler 18 within drum 14 as drum 14 is continuously rotated about the axis of shaft 16. The vanes 22 and annular members 20, 21 roll upon and crush solid lumps engaged beneath tumbler 18 between its outside surface and the inner surfaces of drum 14. In addition, the vaned nature of tumbler 18 serves to lift and suspend solid particles in the water. The smaller discrete particles of sand and suspended particles of the lighter binder are carried with the liquid overflow that escapes over the lip 15. The larger lumps of sand and binder remain in drum 14 until they are disintegrated or broken into discrete particles that are washed over lip 15. The result of the tumbling action and crushing within drum 14 is to gradually disintegrate the lumps and place the discrete particles of sand and binder in suspension within a primary slurry that overflows from drum 14 in a continuous fashion.

The greater weight of the larger annular member 21 serves to maintain tumbler 18 at the lower end of the inclined drum 14. Similarly, the heavier lumps of material within drum 14 will also migrate to the lower end of drum 14 and be crushed beneath member 21. The geometry and weight distribution of tumbler 18 assures its loose retention at the lower end of the drum 14 and prevents tumbler 18 from working upwardly along the axis of drum 14.

The particles of sand and binder suspended in the water within drum 14 form a primary slurry used in this system, which overflows into a settling tank 26 (FIGS. 2, 4). The tank 26 contains a vertical wall or baffle 27 which extends continuously across its width and is spaced upwardly from the lower wall 30 of tank 26. The lower edge of baffle 27 is indicated in FIG. 4 by the numeral 28. The wall or baffle 27 creates a still or quiet liquid zone that permits the heavy discrete particles of sand to slide downwardly along the lower inclined wall 30 of tank 26, the lighter discrete particles of binder and foreign materials in the primary slurry remaining in suspension. The particles of sand are constantly engaged and carried upwardly on a ladder conveyor 31 and are thereby removed from the primary slurry.

As will be discussed below, recycled liquid is returned to the exit side of baffle 27 and washes upward under its lower edge 28 (in the flow direction shown by arrow 29 in FIG. 4) as liquid is pumped from tank 26. This serves as a final wash for the sand before it is lifted from tank 26.

The conveyor 31 extends from the bottom of tank 26 to a height substantially above the tank 26. It is inclined from the vertical, permitting the sand to fall by gravity from the top of conveyor 31 to an inclined directing plate 32. The substantial height of conveyor 31 above the elevation of tank 26 and the liquid slurry level indicated generally at 33 serves to permit substantial draining of liquid from the sand before it is deposited onto plate 32.

Figure 5:
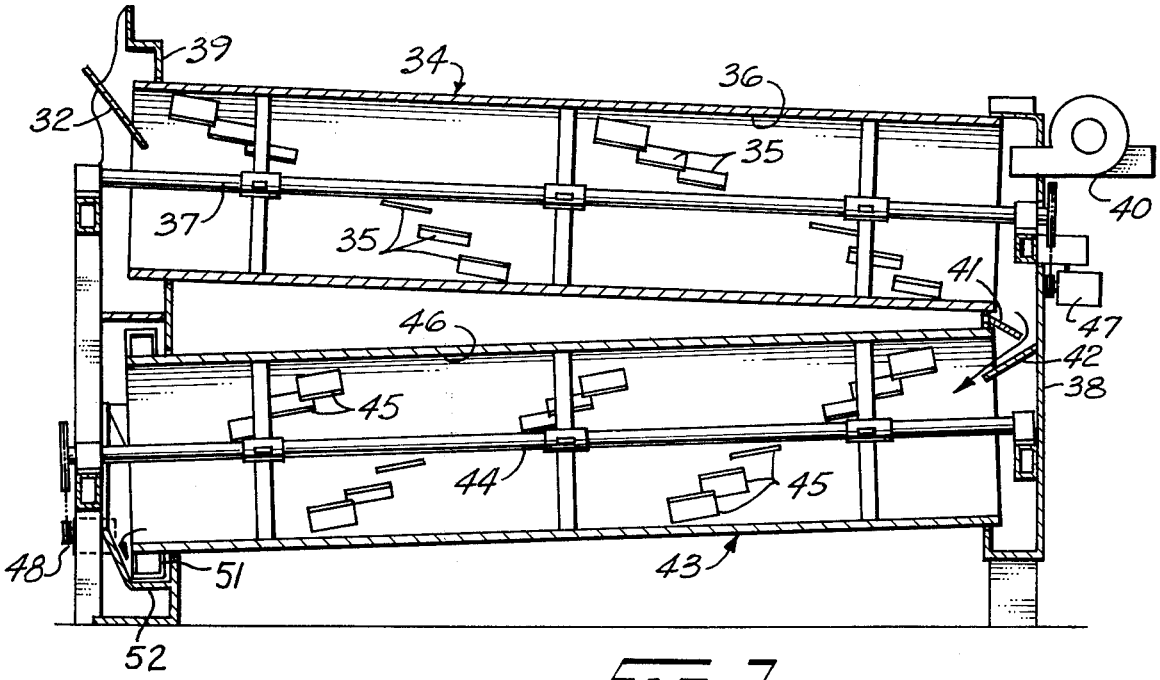
FIG. 5 is a fragmentary sectional view taken along line 5—5 in FIG. 1.

The particles of sand received on the directing plate 32 enter a first drying drum 34 (FIG. 5), which generally tumbles the sand about its walls and moves the sand gradually from the incoming end shown at the left in FIG. 5 to its exit end shown at the right at FIG. 5. The sand is engaged and tumbled by spirally-located fins 35 fixed about the inner cylindrical drum surfaces 36. The support shaft 37 for drum 34 is inclined downwardly from its incoming end to its exiting end. The ends of the drum are substantially enclosed by cover assemblies shown at 38 and 39. Heated air is directed to the interior of drum 34 by a conventional heater and blower unit shown at 40.

After completing the circuit through drum 34, the sand falls onto oppositely directing plates 41, 42 which lead the sand into a second drying drum 43. The structure of drum 43 is substantially similar to that of drum 34. It is located immediately below drum 34. Its supporting shaft 44 is inclined oppositely to shaft 37, thereby permitting the sand to tumble within drum 43 while traveling from right to left as shown in FIG. 5. Tumbling of the sand is facilitated by spirally located fins 45 fixed about the inner drum surfaces 46.

The drums 34 and 43 are individually rotated by powered drive units shown respectively at 47 and 48. The speed of each drum can be individually controlled to permit proper drying of sand in a given unit.

An exterior blower unit 50 controls flow of air through drums 34, 43. It discharges to atmosphere. Cool outside air is drawn into the exit end of drum 43 through an opening at the lower end of cover assembly 39. It passes through drum 43 and moves upwardly through cover assembly 38. It is then mixed with heated air at unit 40 and is passed through drum 34 prior to discharge by blower 50. The direction of air movement is opposite to the direction of sand movement in both drums. The moving stream of air intimately flows through the tumbling sand to dry and cool the sand in an efficient progression as the sand travels through the drums 34, 43.

Figure 6:
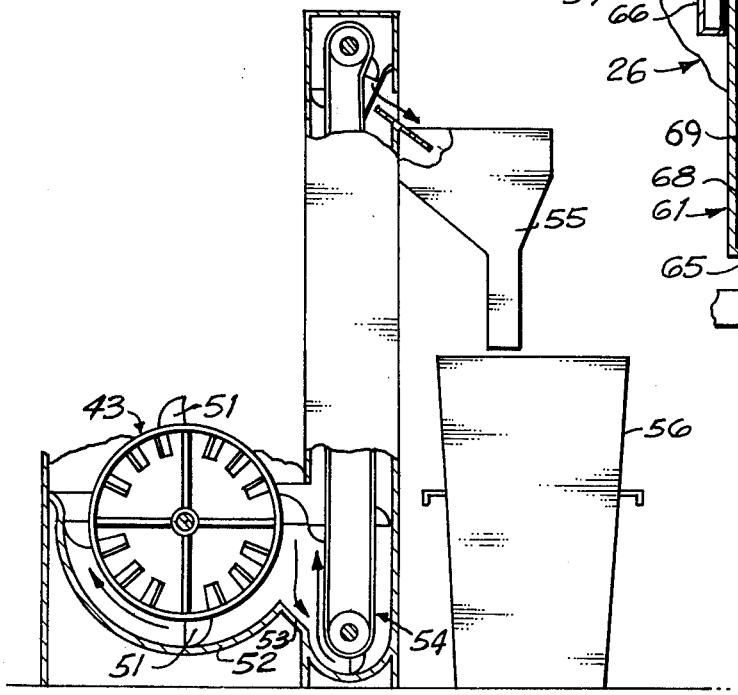
FIG. 6 is slightly reduced view taken substantially along line 6—6 in FIG. 4.

After being dried, the sand is elevated by buckets 51 mounted about the exit end of drum 43 in cooperation with a semi-circular trough 52 (FIG. 6) to which the dried sand is discharged by means of an inclined end plate 53.

The elevated sand in the buckets 51 is discharged into an elevator conveyor assembly 54, which lifts the sand and deposits it in a hopper 55 for reception in a waiting receptacle 56 of any conventional configuration.

Figure 7:
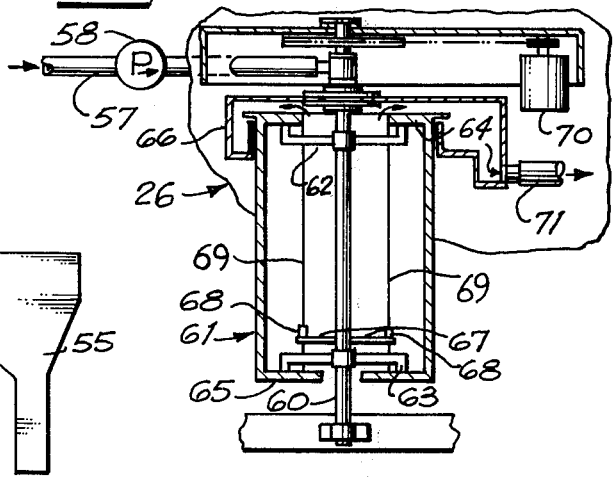
FIG. 7 is a sectional view through the separator as seen substantially along line 7—7 in FIG. 1.

It is necessary to remove the suspended particles remaining in the slurry within tank 26 after sand removal. This is accomplished by a centrifugal separator shown in detail in FIGS. 4 and 7. The slurry is pumped through an inlet pipe 57 that projects into the center of tank 26 at the inlet side of barrier wall 27. The secondary slurry (after sand separation) is discharged continuously during the reclaiming process by a pump 58. It enters the center of a support shaft 60 for a separator drum 61. Drum 61 is coaxially mounted about shaft 60 by upper and lower spider frame 62, 63. Drum 61 has liquid impermeable side walls in a cylindrical configuration and annular top and bottom walls 64, 65 which join the side walls and extend radially inward from the side walls in a direction perpendicular to the axis of shaft 60. The upper annular wall 64 has a center aperture of a radius greater than the corresponding center aperture of the lower wall 65. The upper portion of drum 61 is shrouded within a circular cover assembly 66 open to the center of the drum. The lower wall 65 is open and uncovered.

Liquid is delivered from shaft 60 through a pair of radial discharge pipes 67 having upwardly directed outlets 68. The outlets 68 are located radially from the axis of shaft 60 by a distance substantially equal to the radius of the aperture in the center of the upper wall 64.

Drum 61 is powered by a motor drive unit 70 through conventional belts or chains operatively connected to shaft 60. In use, liquid is delivered through shaft 60 during rotation of drum 61. The drum 61 is rotated at a relatively fast rate. As an example, using a drum that is 16 inches in diameter, it is rotated at 800 revolutions per minute. Incoming liquid is held against the cylindrical walls of the drum by centrifugal force and generally assumes an annular centrifugal configuration as illustrated by lines 69 in FIG. 7. Because the radius of the opening at the upper wall 64 is greater than that in the lower wall 65, excess liquid escapes outwardly over the top of the drum, where it is confined by the cover assembly 66 and delivered by gravity through pipe 71 back to tank 26. The recycled water is discharged at the outlet side of barrier 27.

Solid materials suspended in the secondary slurry within tank 26 are collected along the cylindrical walls of drum 61. The axial direction of the incoming suspension from the outlet pipes 68 serves to direct the incoming liquid in an upward spiral along the inner surfaces of the cylindrical wall of liquid and materials within drum 61. Thus, the incoming liquid does not disrupt the material about the interior of drum 61. Drum 61 is intermittently cleaned by terminating operation of pump 58 and drive unit 70. Drive unit 70 preferably includes a brake mechanism operatively connected to drum 61 to rather abruptly terminate drum rotation. As the drum 61 stops rotating, the remaining liquid along its side walls washes about the drum and falls through the aperture in the lower wall 65, carrying with it any solid materials collected within the drum. These are collected within a waiting receptacle 72 beneath drum 61 for solid waste disposal. The volume of such material is not particularly significant in comparison to the volume of the sand reclaimed in the system.

The apparatus described above and shown in the drawings is a rather compact apparatus for achieving the end result of practical reclamation of sand used in a foundry with a sodium silicate binder. It is capable of substantially continuous use during normal foundry operations, and can contribute significantly to the economic use of sand by permitting reuse of the sand without addition of new sand. The centrifugal separator for the suspended materials removes substantially all fine materials and the silica ions which have plagued prior processes aimed at reclaiming foundry sands.

Some minor modification can be made in the machinery illustrated while maintaining the integrity of the system disclosed herein. For this reason, the invention is defined in the claims which follow, which are to be read in light of this disclosure, but are not to be restricted to the specific details illustrated herein.

Having thus described my invention, I claim:

1. A system for reclaiming used foundry sand containing solid lumps of sand and binder, comprising:

disintegrating the sand and binder into discrete solid particles in a liquid suspension by mechanically crushing the used sand while washing it within a liquid medium;

settling the sand from the liquid medium;

mechanically removing the heavier particles of settled sand;

and continuously drying the sand as it is removed by passage of the sand along first and second successive elongated drying drums, the air system through the drums being connected in tandem, with fresh air being drawn into the sand exit end of the second drum, along the length of that drum to its sand input end, then mixed with heated air at the sand exit end of the first drum, the flow of sand being opposite to the flow of air in both drums.

2. A system for reclaiming used foundry sand containing solid lumps of sand and binder, comprising:

disintegrating the sand and binder into discrete solid particles in a liquid suspension by mechanically crushing the used sand while washing it within a liquid medium;

discharging the suspension into the input side of a settling tank having an elevationally inclined lower wall onto which the sand settles from the suspension, the lower wall being inclined downwardly beneath a transverse barrier spaced upwardly from the lower wall and extending across the width of the tank, whereby the sand moves gravitationally under the barrier;

mechanically removing the sand from the settling tank at the lower end of the tank after passage under the barrier;

and continuously drying the sand after removal by passage of the sand along first and second successive elongated drying drums, the air system through the drums being connected in tandem, with fresh air being drawn into the sand exit end of the second drum, along the length of that drum to its sand input end, then mixed with heated air at the sand exit end of the first drum, the flow of sand being opposite to the flow of air in both drums.

3. A system for reclaiming used foundry sand containing solid lumps of sand and binder comprising:

disentegrating the sand and binder within an inclined cylindrical drum open at its upper end and closed at its lower end, the lumps of sand and binder being crushed by rolling action of an annular vaned tumbler loosely mounted within the interior of the drum and having an outer radius less than the inner radius of the drum;

introducing liquid continuously to the drum interior through its upper end to wash the sand during crushing and tumbling during rotation of the drum;

directing the resulting liquid suspension of particles from the overflow at the upper end of the drum to a settling tank;

settling the sand from the liquid medium;

mechanically removing the heavier particles of settled sand; and continuously drying the sand as it is removed.

* * * * *